US006009722A

United States Patent [19]

Choi et al.

[11] Patent Number: 6,009,722

[45] Date of Patent: Jan. 4, 2000

[54] MOTOR COOLING STRUCTURE FOR TURBO

[75] Inventors: Moon-Chang Choi; Hyeong-Seok Kim; Sang-Wook Lee, all of Kwangmyung, Rep. of Korea

[73] Assignee: LG Electronics Inc., Rep. of Korea

[21] Appl. No.: 09/196,931

[22] Filed: Nov. 20, 1998

[30] Foreign Application Priority Data

Dec. 26, 1997 [KR] Rep. of Korea ..... 97/74728

[51] Int. Cl.[7] ..... F25B 31/00

[52] U.S. Cl. ..... 62/505; 62/83; 62/469; 62/503; 310/54

[58] Field of Search ..... 62/505, 503, 469, 62/83; 310/54

[56] References Cited

U.S. PATENT DOCUMENTS

| | | | |
|---|---|---|---|
| 2,768,511 | 10/1956 | Moody | 62/117.8 |
| 2,770,106 | 11/1956 | Moody | 62/117.8 |
| 2,793,506 | 5/1957 | Moody | 62/117.6 |
| 2,986,905 | 6/1961 | Kocher et al. | 62/475 |
| 3,088,042 | 4/1963 | Robinson | 310/54 |
| 3,106,334 | 10/1963 | Fogleman et al. | 230/117 |
| 3,149,478 | 9/1964 | Anderson et al. | 62/469 |
| 3,150,277 | 9/1964 | Chubb et al. | 310/54 |
| 3,188,833 | 6/1965 | Robinson | 62/505 |
| 3,218,825 | 11/1965 | McClure | 62/505 |
| 3,232,074 | 2/1966 | Weller et al. | 62/505 |
| 3,306,074 | 2/1967 | Wilson | 62/505 |
| 3,805,101 | 4/1974 | Purman | 310/54 |
| 3,805,547 | 4/1974 | Eber | 62/505 |

FOREIGN PATENT DOCUMENTS 9764567 11/1997 Rep. of Korea .

*Primary Examiner*—Henry Bennett
*Assistant Examiner*—Marc Norman
*Attorney, Agent, or Firm*—Ostrolenk, Faber, Gerb & Soffen, LLP

[57] ABSTRACT

A motor cooling structure for a turbo compressor is disclosed. The structure includes a refrigerant suction tube communicating with one lateral wall of the sealed container and extended from the evaporator, a first refrigerant flow tube communicating with another lateral wall of the sealed container, with the first refrigerant flow tube communicating with the first compression chamber, a second refrigerant flow tube through which the first compression chamber communicates with the second compression chamber, and a refrigerant discharge tube communicating with the second compression chamber communicating with a condenser, for thereby enhancing a cooling efficiency of the driving motor by directly introducing a low temperature refrigerant from an evaporator into a motor chamber.

2 Claims, 2 Drawing Sheets

MOTOR COOLING STRUCTURE FOR TURBO

BACKGROUND OF THE INVENTION

1. Field of the Invention

The present invention is directed to a turbo compressor compressing gas using a centrifugal force generated by an impeller, and in particular to a motor cooling structure for a turbo compressor which is capable of implementing an effective cooling operation of a driving motor by introducing a low temperature refrigerant gas from an evaporator into a motor chamber for thereby cooling the driving motor and changing a part of a liquid state refrigerant gas into a gas state based on the heat of the driving motor during the cooling operation for the driving motor for thereby removing an accumulator which is used for changing a liquid state refrigerant gas into a gas state refrigerant.

2. Description of the Conventional Art

Generally, the compressor is a machine for compressing a gas such as air, refrigerant gas, etc. based on a rotation operation of an impeller or a rotor or a reciprocating operation of a piston and is formed of a driving force generator for driving the impeller, rotor and piston and a compression mechanism for sucking gas based on the driving force generated by the driving force generator.

The thusly constituted compressor is classified into a hermetically sealed type or a separation type based on the installed position of the driving force generator and the compression mechanism. In the hermetically sealed type compressor, the driving force generator and the compression mechanism are installed in a predetermined shaped sealed container, and in the separation type compressor, the driving force generator is installed outside the sealed container, so that the driving force generated by the driving force generator is transferred to the compression mechanism of the container.

The hermetically sealed type compressor is classified into a rotary type compressor, a reciprocating type compressor a scroll type compressor. Recently, a turbo type compressor (or centrifugal type compressor) is disclosed, which is directed to sucking gas and compressing the same using a centrifugal force generated when the impeller is rotated.

FIG. 1 illustrates the construction of a two-stage compression type turbo compressor having a Korean Patent Number 97-64567 invented by the inventor of this application. As shown therein, the conventional two stage turbo compressor includes a motor chamber 13 in which a driving motor 20 is installed at the inner center portion of a hermetically sealed container 10 for generating a driving force. A first compression chamber 11 communicating with an accumulator and a second compression chamber 12 is formed at both sides of the sealed container 10.

In addition, a gas flow path 14 is formed along an inner circumferential surface of the hermetically sealed container 10 and an outer circumferential surface of the motor chamber 13 at an inner upper portion of the sealed container 10 for communicating the first and second compression chambers 11 and 12 with the motor chamber 13. An inlet hole 13*a* is formed on a center lower surface of the gas flow path 14, namely, on the upper surface of the motor chamber 13, so that when the first compressed refrigerant gas flows from the first compression chamber 11 into the second compression chamber 12 through the gas flow path 14, a part of the refrigerant gas flows into the interior of the motor chamber 13 for thereby cooling the driving motor 20. An outlet hole

13*b* is formed so that the refrigerant gas which flowed into the motor chamber 13 through the inlet port 13*a* and cooled the driving motor 20 flows to the gas flow path 14 and then to the second compression chamber 12.

In addition, the driving shaft 30 mounted at the motor chamber 13 is engaged with the driving motor 20 with its both ends being inserted into the first and second compression chambers 11 and 12, respectively. First and second impellers 40 and 50 are fixed at both ends of the driving shaft 30 for sucking and compressing the refrigerant gas with its diameter in the direction that the gas is introduced being smaller than the diameter in the direction that the refrigerant gas is compressed and discharged, with its shape being conical when viewed from the driving shaft 30.

In addition, the first and second compression chambers 11 and 12 include first and second inducers (not shown) communicating with the gas flow path 14 for guiding the refrigerant gas sucked, and first and second diffusers 11*a* and 12*a* and first and second volutes 11*b* and 12*b* for changing the kinetic energy of the refrigerant gas having its pressure increased by the first and second impellers 40 and 50 to a constant energy.

A radial bearing 60 is engaged with the driving shaft 30 and the motor chamber 13 for thereby radially supporting the driving shaft 30 engaged with the driving motor 20 at both sides of the driving motor 20 engaged in the motor chamber 13. A thrust bearing 70 is fixedly engaged to the driving shaft 30 for supporting the driving shaft 30 at the outer portion of the radial bearing 60 and at the inner wall of both sides of the motor chamber 13.

In the drawings, reference numeral 10*a* represents a suction port, and 10*b* represents a discharge port.

The operation of the conventional 2-stage compression type turbo compressor will be explained with reference to the accompanying drawings.

Namely, in the conventional two-stage compression type turbo compressor, when an induction magnetic field is formed at the driving motor 20 by the electric power applied, the driving shaft 30 is rotated at a high speed by the induction magnetic force. The first and second impellers 40 and 50 fixed to both ends of the driving shaft 30 are rotated for thereby sucking the refrigerant gas from the evaporator (not shown) into the first compression chamber 11.

At this time, since the refrigerant gas sucked from the evaporator into the first compression chamber 11 has a low temperature, a part of the refrigerant gas exists in a liquid state. When the compression process is executed, the compression efficiency is significantly decreased. Therefore, an accumulator is installed between the evaporator and the first compression chamber 11 for changing the liquid state refrigerant gas into a gas state and for transmitting the same into the first compression chamber.

The refrigerant gas sucked into the first compression chamber 11 from the evaporator through the accumulator by the rotation force of the first and second impellers 40 and 50 is induced into the first inducer and then is accelerated by the first impeller 40. The thusly accelerated refrigerant gas is introduced into the first volute 11*b* through the first diffuser 11*a* and is first compressed thereby.

The first compressed gas is sucked into the second compression chamber 12 through the gas flow path 14 by the rotation force of the second impeller 50.

At this time, a part of the compressed gas sucked into the second compression chamber 12 through the gas flow path 14 flows into the interior of the motor chamber 13, in which the driving motor 20 is installed, through the inlet hole 13*a* formed on the lower surface of the gas flow path 14, namely, on the upper portion of the motor chamber 13, and the compressed gas cools the driving motor 20, and is discharged to the gas flow path 14 through the outlet hole 13*b* formed at the upper portion of the motor chamber 13 and then is combined with the first compressed gas and is sucked into the second compression chamber 12.

The first compressed gas sucked into the second compression chamber 12 by the rotation force of the second impeller 50 is induced by the second inducer and accelerated by the second impeller 50, and the thusly accelerated refrigerant gas flows into the second volute 12*b* through the second diffuser 12*a* for thereby implementing a second stage compression. The thusly second compressed refrigerant gas is discharged into the condenser (not shown) through the discharge port 10*b*.

In addition, since the driving shaft 30 is continuously rotated with no load during the refrigerant gas compression process, the driving shaft 30 may move either in the radial direction or the axial direction. In order to overcome the abovedescribed problem, the movement of the same in the radial and axial directions is prevented by the radial bearing 60 disposed at both sides of the driving motor 20 and the thrust bearing 70 disposed at both outer portions of the radial bearing 60.

In the conventional 2-stage compression type turbo compressor, the refrigerant gas is sucked from the evaporator into the compression chambers 11 and 12 by the centrifugal force of the impellers 40 and 50 engaged with both ends of the driving shaft 30. At this time, the driving motor 20 is cooled using the first compressed gas.

However, in the conventional 2-stage compression turbo compressor, the operation for cooling the driving motor is performed using a high temperature compressed gas which is first compressed by the first compression chamber, so that the cooling efficiency is decreased.

In addition, in the conventional 2-stage compression turbo compressor, since the refrigerant gas introduced from the evaporator into the first compression chamber has a low temperature, a part of the refrigerant gas exists in a liquid state. If the refrigerant gas which partially exists in a liquid state is directly compressed, the compression efficiency is significantly decreased. Therefore, an accumulator is additionally needed for fully changing the liquid state refrigerant gas into a gas state and then introducing the same into the first compression chamber for increasing the compression efficiency, thereby increasing the fabrication cost.

SUMMARY OF THE INVENTION

Accordingly, it is an object of the present invention to provide a motor cooling structure for a turbo compressor which overcomes the aforementioned problems encountered in the conventional art.

It is another object of the present invention to provide a motor cooling structure for a turbo compressor which is capable of enhancing a cooling efficiency of the driving motor by directly introducing a low temperature refrigerant from an evaporator into a motor chamber.

It is another object of the present invention to provide a motor cooling structure for a turbo compressor which is capable of decreasing the fabrication cost by fully changing a part of the liquid state refrigerant gas introduced from the evaporator into the first compression chamber into a gas state refrigerant without using an accumulator.

To achieve the above objects, there is provided a motor cooling structure for a turbo compressor which includes a refrigerant suction tube communicating with one lateral wall of the sealed container and extended from the evaporator; a first refrigerant flow tube communicating with another lateral wall of the sealed container, with the first refrigerant flow tube communicating with the first compression chamber; a second refrigerant flow tube through which the first compression chamber communicates with the second compression chamber; and a refrigerant discharge tube communicating with the second compression chamber communicating with a condenser.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The motor cooling structure for a turbo compressor according to the present invention will be explained with reference to the accompanying drawings.

Figure 1:
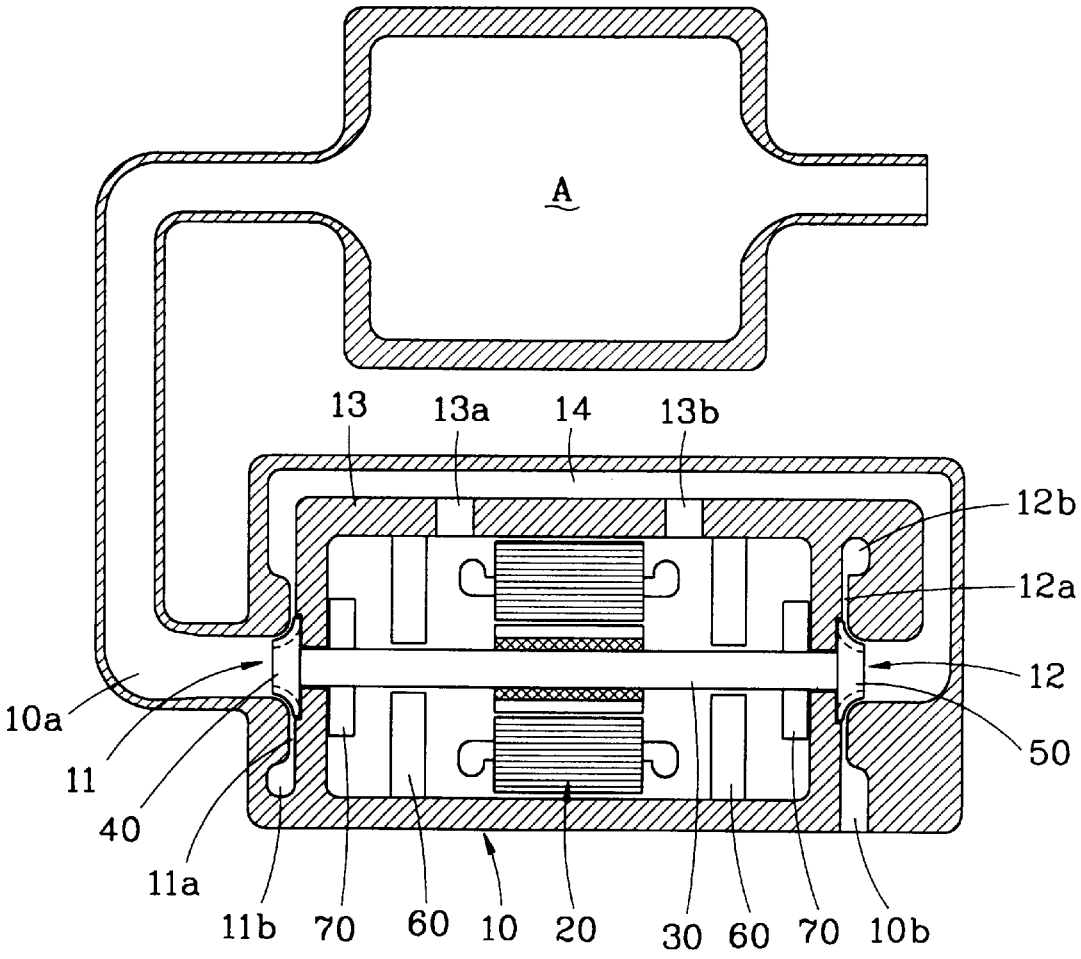
FIG. 1 CONVENTIONAL ART
FIG. 1 is a vertical cross-sectional view illustrating he construction of a conventional two-stage compression type turbo compressor.
Figure 2:
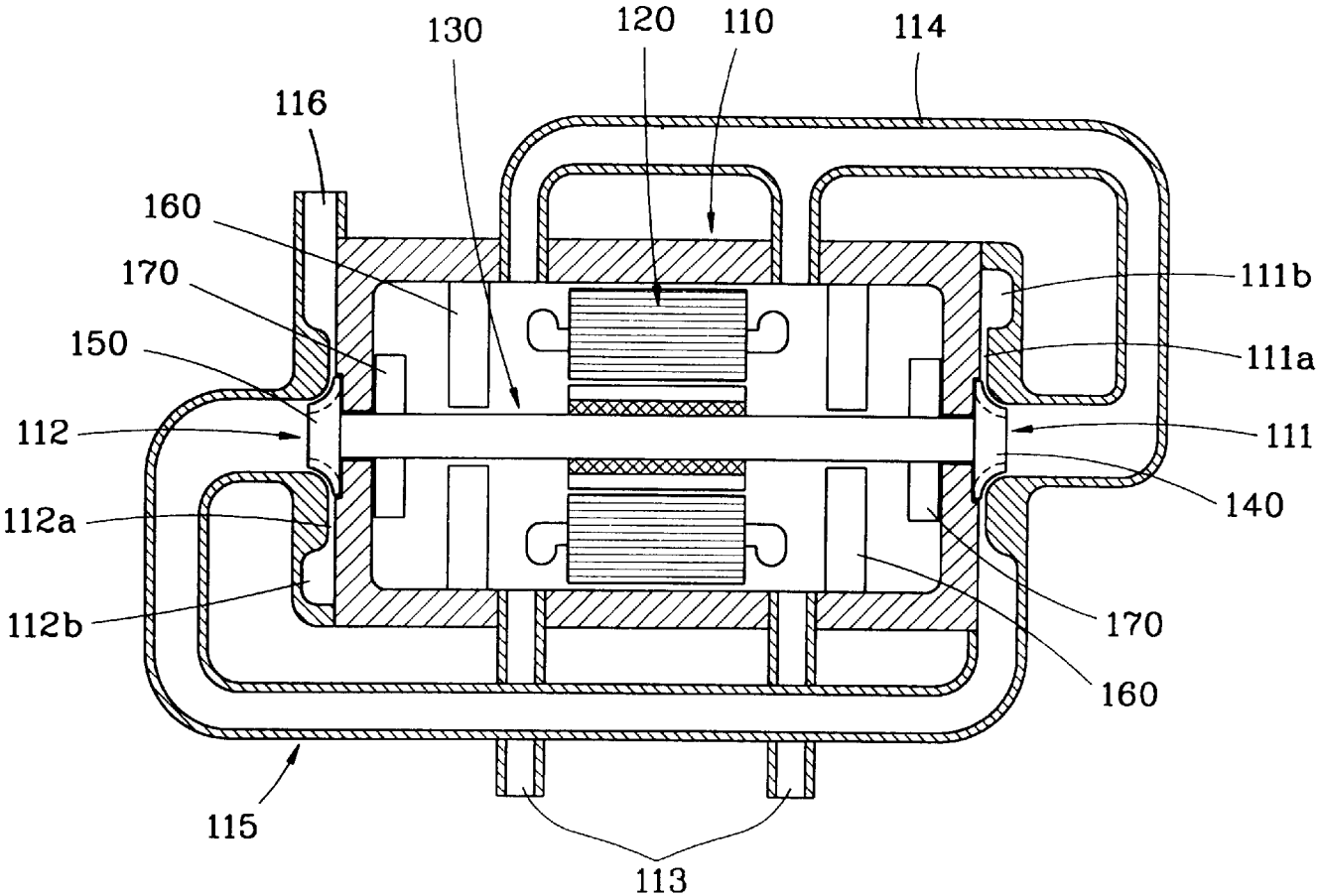
FIG. 2 is a vertical cross-sectional view illustrating the construction of a turbo compressor having a motor cooling structure according to the present invention.

As shown in FIG. 2, in a turbo compressor including a motor chamber in which a driving motor 120 is installed, a hermetically sealed container 110 in which first and second compression chambers 111 and 112 communicate with each other for compressing a refrigerant gas sucked from both sides of the same, a driving shaft 130 engaged with the driving motor 120 with its both ends being inserted into the first and second compression chambers 111 and 112, and first and second impellers 140 and 150 engaged with both ends of the driving shaft 130 for compressing the refrigerant gas based on a two-stage centrifugal compression method. A motor cooling structure for the turbo compressor comprises a refrigerant suction tube 113 communicating with one lateral wall of the sealed container 110 and extended from the evaporator (not shown); a first refrigerant flow tube 114 communicating with another lateral wall of the sealed container 110, with the first refrigerant flow tube 114 communicating with the first compression chamber 111; a second refrigerant flow tube 115 through which the first compression chamber 111 communicates with the second compression chamber 112; and a refrigerant discharge tube 116 communicating with the second compression chamber 112 and communicating with a condenser (not shown). The refrigerant suction tube 113 and the first refrigerant flow tube 114 are connected with both sides of the driving motor 120.

In addition, the refrigerant suction tube 113 and the first refrigerant flow tube 114 are connected with both sides of the driving motor 120 for implementing an easier flow of the refrigerant gas in the interior of the sealed container 110.

In the drawings, reference numeral 160 represents a radial bearing, and 170 represents a thrust bearing.

The operation of the turbo compressor having a motor cooling structure according to the present invention will now be explained.

Namely, in the turbo compressor having a motor cooling structure according to the present invention, when the driving shaft 130 is rotated by the driving motor 120, the first and second impellers 140 and 150 engaged with both ends of the driving shaft 130 are rotated to thereby suck a low temperature refrigerant gas from the evaporator through the refrigerant suction tube 113.

The low temperature refrigerant gas sucked into the refrigerant suction tube 113 passes through the sealed container 110 and flows into the first refrigerant flow tube 114 since the refrigerant suction tube 113 communicates with the sealed container 110.

At this time, since the motor chamber is formed in the interior of the sealed container 110, the low temperature refrigerant gas sucked from the evaporator into the sealed container 110 through the refrigerant suction tube 113 passes through the interior of the sealed container 110 and cools the driving motor 120.

In addition, a part of the refrigerant gas sucked from the evaporator into the sealed container 110 is in a liquid state. However, when the refrigerant gas containing a liquid state refrigerant passes through the interior of the sealed container 110 and cools the driving motor 120, the liquid state refrigerant is fully changed to a gas state by the heat generated by the driving motor 120, and the gas state refrigerant is discharged into the first refrigerant flow tube 114.

The refrigerant gas discharged into the first refrigerant flow tube 114 is sucked into the first compression chamber 111 along the first refrigerant flow tube 114 and is accelerated by the first impeller 140 and is sprayed over the first diffuser 111*a* and the first volute 111*b* for thereby implementing a first compression operation.

The thusly first compressed refrigerant gas is sucked into the second compression chamber 112 along the second refrigerant flow tube 115 communicating with the first compression chamber 111 and is accelerated by the second impeller 150 and is sprayed over the second diffuser 112*a* and the second volute 112*b* for thereby implementing a second compression operation, and the second compressed refrigerant gas flows into the condenser through the refrigerant discharge tube 116 communicating with the condenser for thereby completing a compression process of the refrigerant gas.

The connection between the sealed container 110 and the refrigerant suction tube 113 may be implemented based on a single tube connection. Preferably, the end portion of the refrigerant suction tube 113 extended from the evaporator or the accumulator may be divided into multiple connection portions for thereby connecting the refrigerant suction tube 113 to both sides of the driving motor 120 of the sealed container 110. The first refrigerant flow tube 114 may be connected to both sides of the driving motor 120 like the refrigerant suction tube 113 for thereby implementing an efficient refrigerant flow in the sealed container 110 for thereby enhancing the efficiency of the compressor.

The present invention may be well applicable for a face-to-face structure in which the suction portions of the first and second impellers 140 and 150 are opposite to each other.

As described above, in the motor cooling structure for a turbo compressor according to the present invention, since a low temperature refrigerant gas from the evaporator sucked by the rotation of the first and second impellers passes through the interior of the sealed container and flows into the first compression chamber, so that the low temperature refrigerant gas directly cools the driving motor for thereby enhancing the cooing efficiency of the driving motor.

In particular, a liquid state refrigerant which flows from the evaporator passes through the interior of the sealed container and is fully changed to a gas state refrigerant during the process for cooling the driving motor. Therefore, in the present invention, an accumulator is not needed for fully changing the liquid state refrigerant into a gas state refrigerant for thereby increasing the fabrication cost and implementing a simple structure of the turbo compressor.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A motor cooling structure for use in a turbo compressor, the turbo compressor including a motor chamber having a driving motor therein, including a hermetically sealed container both ends of which are engaged with first and second impellers, respectively, for compressing a refrigerant gas based on a two-stage centrifugal compression method, the first and second impellers constituting a first compression chamber and a second compression chamber, respectively, the motor cooling structure comprising:

a refrigerant suction tube through which one lateral wall of the sealed container communicates with an evaporator;

a first refrigerant flow tube through which another lateral wall of the sealed container communicates with the first compression chamber;

a second refrigerant flow tube through which the first compression chamber communicates with the second compression chamber; and a refrigerant discharge tube through which the second compression chamber communicates with a condenser, the refrigerant gas supplied from the evaporator flowing through, in order, the refrigerant suction tube, the motor chamber of the sealed container, the first refrigerant flow tube, the first compression chamber, the second refrigerant flow tube, the second compression chamber and the condenser.

2. The structure of claim 1, wherein said refrigerant suction tube and said first refrigerant flow tube are connected with both sides of the driving motor.

* * * * *

UNITED STATES PATENT AND TRADEMARK OFFICE

CERTIFICATE OF CORRECTION

PATENT NO :6,009,722

DATED : January 4, 2000

INVENTOR(S) : Moon-Chang Choi; Hyeong-Seok Kim; Sang-Wook Lee

It is certified that error appears in the above identified patent and that said Letters Patent is hereby corrected as shown below.

Title page, item [54] and col. 1, line 1-2, should read
"MOTOR COOLING STRUCTURE FOR TURBO COMPRESSOR"

Signed and Sealed this

Twenty-fifth Day of July, 2000

*Attest:*

*Attesting Officer*

Q. TODD DICKINSON

*Director of Patents and Trademarks*